US008099891B2

(12) United States Patent
Maier-Hunke

(10) Patent No.: US 8,099,891 B2
(45) Date of Patent: Jan. 24, 2012

(54) CARD HOLDER CLIP

(75) Inventor: Horst-Werner Maier-Hunke, Iserlohn (DE)

(73) Assignee: Durable Hunke & Jochheim GmbH & Co. KG, Iserlohn (DE)

( * ) Notice: Subject to any disclaimer, the term of this patent is extended or adjusted under 35 U.S.C. 154(b) by 110 days.

(21) Appl. No.: 12/646,236

(22) Filed: Dec. 23, 2009

(65) Prior Publication Data

US 2011/0147422 A1 Jun. 23, 2011

(51) Int. Cl.
*G09F 3/16* (2006.01)
*B42F 1/02* (2006.01)

(52) U.S. Cl. ..... 40/658; 40/617; 24/545; 24/561; 24/556

(58) Field of Classification Search ..... 248/316.7; 24/3.12, 3.11, 716, 910, 545, 561, 556; 40/652, 40/658, 648
See application file for complete search history.

(56) References Cited

U.S. PATENT DOCUMENTS

| | | | | |
|---|---|---|---|---|
| 2,729,868 | A * | 1/1956 | Manning | 24/545 |
| 3,399,429 | A * | 9/1968 | Goodman | 24/67 R |
| D266,858 | S * | 11/1982 | Cole | D19/90 |
| 4,557,064 | A * | 12/1985 | Thompson | 40/661.03 |
| 4,899,974 | A * | 2/1990 | Wear et al. | 248/467 |
| D398,651 | S * | 9/1998 | Suzuki | D19/90 |
| 5,836,097 | A * | 11/1998 | Lewis et al. | 40/658 |
| D480,949 | S * | 10/2003 | Kosir | D8/373 |
| 6,637,716 | B2 * | 10/2003 | Wear | 248/489 |
| D486,863 | S * | 2/2004 | Coe | D19/65 |
| 7,487,611 | B2 * | 2/2009 | Robb | 40/658 |
| D613,796 | S * | 4/2010 | Kim | D19/86 |
| 7,721,659 | B2 * | 5/2010 | Fast | 108/60 |
| 2002/0029505 | A1 | 3/2002 | Faneuf | |
| 2003/0101545 | A1 | 6/2003 | Hsiao | |
| 2003/0126722 | A1 * | 7/2003 | Thompson | 24/3.12 |
| 2006/0117630 | A1 | 6/2006 | Raia et al. | |
| 2008/0104801 | A1 * | 5/2008 | Yeh | 24/3.12 |

FOREIGN PATENT DOCUMENTS

| | | | |
|---|---|---|---|
| DE | 650290 | A | 9/1937 |
| DE | 7525780 | U | 11/1975 |
| EP | 2178070 | A1 * | 4/2010 |
| GB | 2298890 | A | 9/1996 |
| JP | 10114182 | A | 5/1998 |
| JP | 2006315382 | A | 11/2006 |

OTHER PUBLICATIONS

Search report for German patent application No. 10 2008 051 191. 9-55, dated Jun. 9, 2009 (3 pages).

* cited by examiner

*Primary Examiner* — Casandra Davis
(74) *Attorney, Agent, or Firm* — Edell, Shapiro & Finnan LLC

(57) ABSTRACT

The present invention relates to a holder clip (1) for cards, such as identification cards, comprising two holding arms (3, 4) interconnected by a yoke (2) and defining between them a card reception slot (5). In order to be able to hold also cards of various thicknesses with adequate holding force by means of the holder clip (1), the present invention is so conceived that at least one of the two holding arms (3, 4) is provided with at least one contact-pressure pad (6) bulging, at least in certain sections thereof, towards the respective other holding arm (3, 4), said contact-pressure pad (6) consisting of a material that is different from the material of the holding arms (3, 4).

9 Claims, 2 Drawing Sheets

CARD HOLDER CLIP

FIELD OF THE INVENTION

The present invention relates to a holder clip for cards, such as identification cards, comprising two holding arms interconnected by a yoke and defining between them a reception slot which is open in a direction opposite to the direction of card insertion.

BACKGROUND OF THE INVENTION

Card holders of the above-mentioned type are known. They are attached e.g. to neck chains or bunches of keys so that an identification card can there be carried such that it is easily visible for possible security personnel. The reception slot of the card holder is normally provided with holding elements which project, at least in certain sections thereof, into the reception slot transversely to the direction of insertion and which establish a frictional, non-positive and/or positive engagement with a card inserted into the slot, so as to retain the card. In particular the frictional engagement can be improved when the holding elements have a comparatively high frictional coefficient.

Such a card holder is described e.g. in US patent application 2006/0117630 A1. The holding arms of this card holder enclose a card reception space which is open in a direction opposite to the direction of card insertion, said reception space being provided with a resilient insert secured in position by a positive connection. The resilient insert has two arms which extend from a yoke and from which holding segments extend whose flat heads are disposed in opposed relationship with one another, said holding segments defining between them a reception slot for the card. The holding segments are inclined in the direction of insertion so as to facilitate insertion of the card and make removal of the card more difficult.

The publication DE 75 25 780 U shows a holder with two clamping pieces defining a reception slot for flat identification carriers, a lobe formed integrally with the holder allowing said identification carriers to be retained safely.

The publication DE 650 290 A describes a price tag holder in the case of which curved portions are defined by an undulating insertion slot, said curved portions guaranteeing a tight fit of a piece of cardboard inserted into the insertion slot.

The known card holders and in particular the card holder specified in US patent application 2006/0117630 A1, which is the type of card holder referred to in the present application, are disadvantageous insofar as they cannot be used in a satisfactory manner for cards of various thicknesses or for other items to be held, such as individual thin sheets of paper or plastic material. The holding elements predetermine a fixed minimum gap width and are incapable of holding cards or the like whose thickness is smaller than this gap width. If the cards in question are, however, comparatively thick, there will be a disproportionately high increase in the force required for insertion and removal because the predetermined slot width is exceeded by far and because this entails a strong deformation of the holding elements which may, consequently, be damaged.

SUMMARY OF THE INVENTION

It is therefore the object of the present invention to improve the card holder referred to at the beginning and especially to allow cards of various thicknesses to be held gently and with an adequate holding force.

In the case of a holder clip of the type specified at the beginning, the present invention achieves this object in that at least one of the two holding arms is provided with at least one contact-pressure pad bulging, at least in certain sections thereof, towards the respective other holding arm, said contact-pressure pad consisting of a material that is softer than the material of the holding arm.

In comparison with the prior art, this solution has the advantage that the bulging shape of the contact-pressure pad allows, thanks to the elasticity of the pad, a frictional and nonpositive engagement with the item to be gripped at certain points thereof, said item to be gripped being a card or a stack of sheets to be held. Especially in the case of cards provided with a recess or a holding aperture, the bulge can additionally engage said recess or said holding aperture and establish a positive engagement with the card. In addition, cards of various thicknesses can, with an adequate expenditure of energy, be inserted into the reception slot along the bulge and positioned, until they strike against an apex of the yoke, in all directions with an identical expenditure of energy.

The solution according to the present invention can be combined arbitrarily with the additional embodiments following hereinbelow, each of which is advantageous individually, and improved still further: a first possible, advantageous embodiment of a holder clip according to the present invention can be so conceived that the contact-pressure pad overlaps, at least in certain sections thereof, the opposed holding arm in the direction of insertion. It follows that there is no gap between the contact-pressure pad acting as a holding element and the holding arm opposed thereto at the reception slot. A minimum thickness of the cards to be held is therefore not predetermined by the width of a reception slot, and arbitrarily thin cards can be held by a holder clip according to the present invention.

According to another possible advantageous embodiment, one of the holding arms can be provided with an opening into which the contact-pressure pad of the other holding arm projects. The opening can be implemented e.g. as a mere recess or as a through-hole. Due to the fact that the contact-pressure pad projects into the opening, an overlapping mode of arrangement of the contact-pressure pad and of the opposed holding arm can easily be realized.

The elastic properties of the contact-pressure pad can, according to another possible advantageous embodiment, be improved when, on a side facing away from the reception slot, the contact-pressure pad is provided with a recess curved in the direction of the reception slot. This recess can intentionally weaken the contact-pressure pad so as to avoid an increased material thickness in the area of the calotte-shaped bulge in the direction of the opposed holding arm and so as to improve the deformability of the contact-pressure pad transversely to the direction of insertion. Especially in the case of comparatively thick cards, a disproportionately high increase in the force required for insertion and removal of the card will be avoided in this way. Likewise, the holding forces applied to cards of various thicknesses will, thanks to the improved elasticity of the contact-pressure pad, be similarly strong, i.e. they will not increase excessively when the cards in question are comparatively thick and they will not decrease excessively when the cards in question are comparatively thin.

According to another possible advantageous embodiment, the holding arm provided with the contact-pressure pad can have formed therein an opening into which the contact-pressure pad is, at least partially, inserted. The opening may also be implemented as a through-hole surrounding the contact-pressure pad at least partially. The contact-pressure pad will thus be held more effectively on the holding arm, in particular parallel to the direction of insertion. A detachment of the contact-pressure pad from the holding arm during movement of a card in the reception slot can be avoided in this way.

According to another possible advantageous embodiment, insertion of a card into the reception slot can be facilitated in that, at least in the direction of insertion, a surface of the holding arm facing the reception slot merges with a surface of the contact-pressure pad essentially without any step being formed therebetween. Hence, a card can easily be pushed onto the contact-pressure pad along the holding arm provided with the contact-pressure pad. In other words, the surface of the contact-pressure pad continues, in a connection or transition area to the clamping/holding arm provided with the contact-pressure pad, in a clamping/holding arm surface such that it is at least areawise flush therewith, or is formed such that it is flush with said holding arm surface. From this surface, the bulge of the contact-pressure pad can rise in the direction of the opposed holding arm, whereby a card can be pushed onto this bulge more easily.

According to another possible advantageous embodiment, the contact-pressure pad can be formed such that a substance-to-substance bond exists between said contact-pressure pad and one of the two holding arms. The substance-to-substance bond guarantees an intimate connection between the contact-pressure pad and the holding arm, which will have the effect that the contact-pressure pad will be held more effectively on the holding arm and that the stability of a holder clip according to the present invention will be improved.

Another possible advantageous embodiment can be so conceived that, on a side facing away from the reception slot, said embodiment comprises a fastening element which extends from the yoke and which is provided with fastening means. The fastening means, e.g. a hole in the fastening element, can easily be used for attaching thereto attachment means, e.g. neck chains or the rings of a bunch of keys.

The handling of a holder clip provided with a fastening element according to the present invention can be improved when another possible advantageous embodiment of said holder clip is so conceived that, when seen in a lateral cross-section of the card holder, the fastening element extends from the middle of the yoke. Due to the central mode of arrangement of the fastening element on the yoke, tension forces applied to the fastening element will be transmitted to the holder clip along a centre axis or centre plane, i.e. said holder clip can be suspended in a largely balanced condition, whereby the representation of cards held in said clip can be improved in comparison with an oblique, non-balanced mode of suspension.

According to another possible advantageous embodiment, the holder clip can be implemented as an injection moulded part. For example, a main body, which comprises the yoke as well as the holding arms, and also the contact-pressure pad can easily be produced from thermoplastic synthetic materials which are adapted for use in injection moulding processes. This will contribute to a reduction of the manufacturing costs of a holder clip according to the present invention. In addition, it is imaginable to produce an intimate, positive connection, which may be a substance-to-substance bond, between the contact-pressure pad and the main body, when the contact-pressure pad is applied to or incorporated in the main body by injection moulding.

BRIEF DESCRIPTION OF THE DRAWINGS

In the following, the present invention will exemplarily be explained in more detail on the basis of advantageous embodiments and with reference to the drawings. The embodiments described only represent possible embodiments in the case of which the individual features can, however, be realized independently of one another or omitted. In the explanations, identical elements of the present invention will always have assigned thereto identical reference numerals so as to avoid unnecessary, repetitive descriptions.

DETAILED DESCRIPTION OF THE INVENTION

Figure 1:
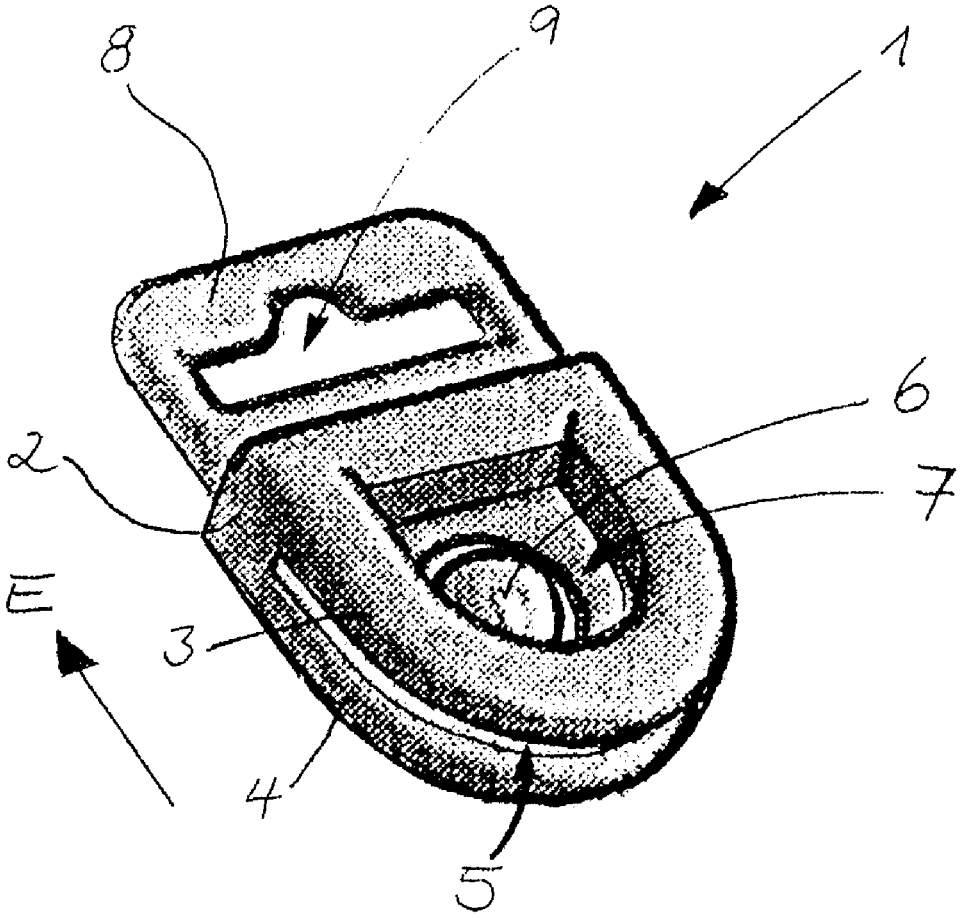
FIG. 1 shows a schematic perspective view of a holder clip according to the present invention.

To begin with, a holder clip 1 according to the present invention will be explained on the basis of the schematic perspective view shown in FIG. 1. The holder clip 1 comprises two holding arms 3, 4 interconnected by a yoke 2. The holding arms 3, 4 are disposed in spaced apart relationship and define between them a reception slot 5 for a card, such as an identification card. The reception slot 5 has provided therein a calotte-shaped contact-pressure pad 6 which bulges from the holding arm 4 towards the holding arm 3. In an area of the holding arm 3 located opposite said contact-pressure pad 6, said holding arm 3 is provided with an opening 7 in the form of a through-hole into which the contact-pressure pad 6 projects.

On a side of the yoke 2 facing away from the reception slot 5, the holder clip 1 is provided with a fastening element 8. The fastening element 8 comprises fastening means 9 in the form of a through-hole or opening. The fastening means 9 can have fastened thereto attachment means (not shown), such as bands or key rings, so that the holder clip 1 can easily be carried.

Figures 2, 3, 4:
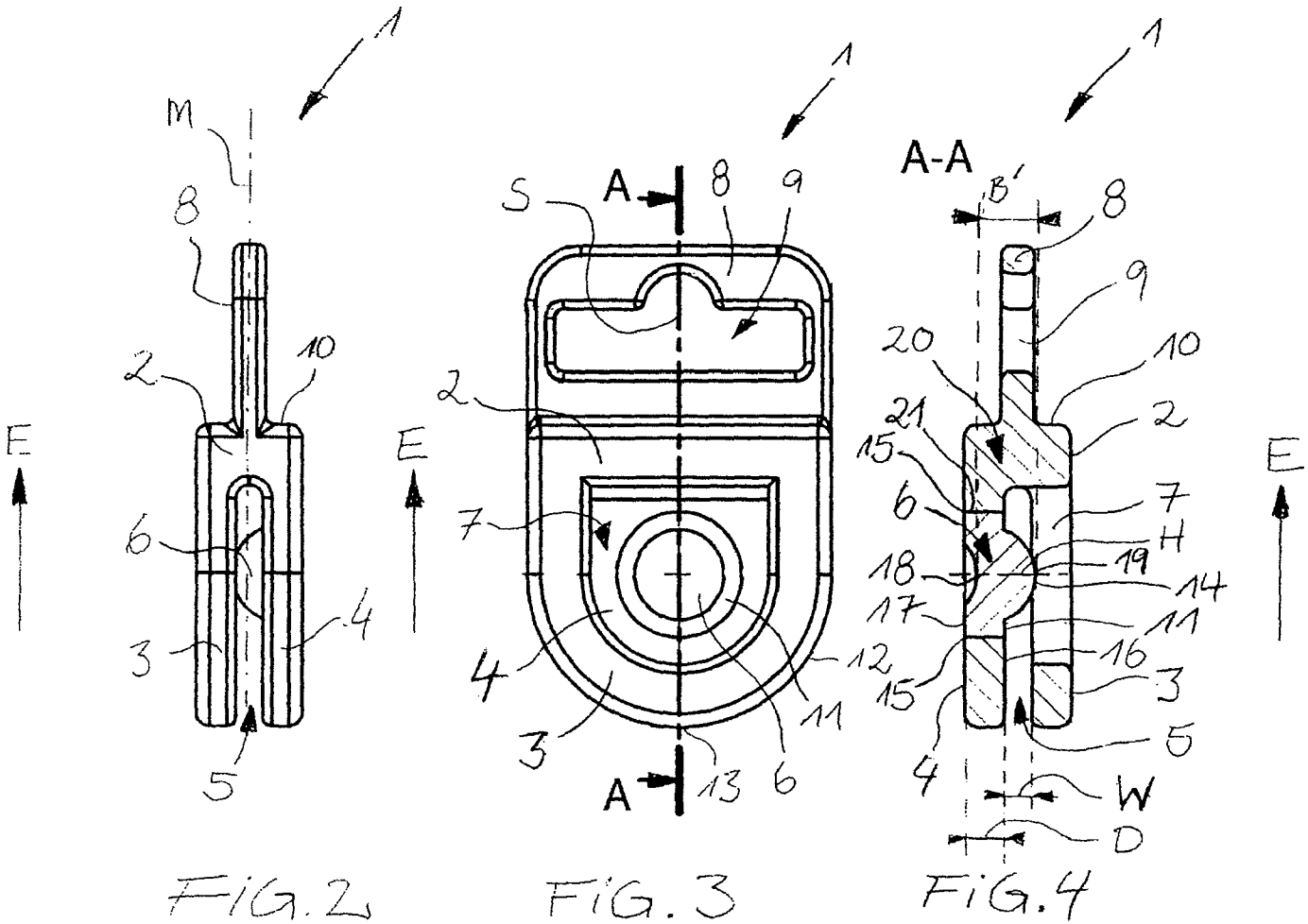
FIG. 2 shows a schematic side view of a holder clip according to the present invention.
FIG. 3 shows a schematic front view of a holder clip according to the present invention.
FIG. 4 shows a schematic sectional view of a holder clip according to the present invention along the cutting line A-A in FIG. 3.

FIG. 2 shows the holder clip 1 according to FIG. 1 in a schematic side view. This figure shows clearly that the contact-pressure pad 6 bulges from the holding arm 4 and overlaps the holding arm 3. It follows that no gap or clearance predefining a minimum thickness of the items that can be fixed with the holder clip 1 exists between the contact-pressure pad 6 and the opposed holding arm 3 in a direction of insertion 3 when seen in a projection view. Arbitrarily thin cards or e.g. plates, sheets or stacks of sheets can therefore be received and held reliably by the holder clip 1 in the reception slot 5.

Furthermore, it can be seen in FIG. 2 that the fastening element 8 extends centrally from a yoke side 10 facing away from the reception slot. The holding arms 3, 4, the yoke 2 and the fastening element 8 are therefore arranged symmetrically with respect to a centre axis M of the holder clip 1.

FIG. 3 shows the holder clip 1 of FIGS. 1 and 2 in a schematic front view. This view makes particularly clear that the contact-pressure pad 6 is arranged on the holding arm 4 directly opposite the opening 7 in the holding arm 3. The circumference of the opening 7 is larger than that of the contact-pressure pad 6, which bulges from a flat portion of a surface 11 facing the holding arm 3. The fact that the circumference of the opening 7 is larger than the circumference of the contact-pressure pad 6 is advantageous insofar as in particular comparatively thick items to be gripped which have a certain degree of elasticity will be able to adapt to the contour of the contact-pressure pad 6 and of the opening 7, the free space which allows them to do so being provided by the circumferential difference between the contact-pressure pad and the opening.

In addition, it can be seen in FIG. 3 that the holder clip 1 is implemented symmetrically with respect to a symmetry axis S, and that a curve 12 of the holding arms 3, 4 has therefore an apex 13 positioned on the symmetry axis S on the side facing in a direction opposite to the direction of insertion E. In addition to aesthetic aspects, the curve 12 will facilitate an insertion of items to be gripped in the reception slot 5, since the items to be gripped can be oriented at the apex 13 of the curve 12 so as to allow the best possible balanced reception in the holder clip 1.

FIG. 4 shows the holder clip according to FIGS. 1 to 3 in a schematic sectional view along the cutting line A-A in FIG. 3. The cutting line A-A lies on the symmetry axis S of the holder clip 1.

FIG. 4 shows clearly that a calotte or spherical-segment shaped bulge 14 projects from the surface 11, which faces the holding arm 3, up to and into the opening 7 of the holding arm 3. It follows that the contact-pressure pad 6, i.e. the bulge 14 thereof, overlaps with the holding arm 3 in the direction of insertion E. Items to be gripped whose thickness is smaller than a width W of the reception slot 5 or whose thickness does not substantially exceed said width can be inserted into the reception slot 5. In order to allow the items to be gripped to be pushed onto the contact-pressure pad 6 and its bulge 14, the surface 11 of the contact-pressure pad 6 is, in a connection area 15 between the contact-pressure pad 6 and the holding arm 4, flush with a side, i.e. surface, 16 of the holding arm 4 facing the holding arm 3. In other words, there is no step between the surface 16 of the holding arm 3 and the surface 11 of the contact-pressure pad 6.

Especially in the case of comparatively thick items to be gripped, the recess 18 provided on the side 17 of the contact-pressure pad 6 facing away from the reception slot 5 will be of advantage. The recess 18 is arranged on a symmetry axis H of the contact-pressure pad 6 on which also an apex 19 of the bulge 14 of the contact-pressure pad 6 lies. The recess 18 weakens the contact-pressure pad 6 in an area in which, due to the bulge 14, the pad thickness B corresponds to a maximum thickness B' which exceeds a thickness D of the holding arm 4. This has the effect that the elasticity of the contact-pressure pad 6 is improved transversely to the direction of insertion E, i.e. along the symmetry axis H of the contact-pressure pad 6, and that the contact pressure force applied by the contact-pressure pad 6 to the items to be gripped in the direction of the holding arm 3 transversely to the direction of insertion E will not increase excessively when a thickness of the item to be gripped corresponds approximately to the width W of the reception slot 5.

In addition, it can be gathered from FIG. 4 that the contact-pressure pad 6 consists of a material which differs from the material of a main body 20 of the holder clip 1 comprising the yoke 2, the holding arms 3, 4 and the fastening element 8. The main body 20 may, for example, consist of a plastic material, such as acryl nitrile butadiene styrene (ABS), as a hard component, and the contact-pressure pad 6 may consist of a thermoplastic elastomer (TPE). The main body 20 and the contact-pressure pad 6 may be formed in injection moulding processes. In this respect, it will be particularly advantageous when the contact-pressure pad 6 is applied by injection moulding to the main body 20 or the opening 21 in the holding arm 4. In so doing, the recess 18 in the contact-pressure pad 6 having the form of a calotte can be used as an injection point.

It will be of advantage when, as can be seen in FIG. 4, the contact-pressure pad 6 is embedded in the opening 21 of the holding arm 4. The contact-pressure pad 6 will thus be firmly held on the holding arm 4 and cannot be detached from the holding arm 4, i.e. the main body 20, especially when forces acting in the direction of insertion E are applied thereto. In addition, the embedding of the contact-pressure pad 6 in the opening 21 allows a structural design of the holder clip 1 which is as flat as possible and which will therefore occupy little space.

Deviations from the above-described embodiment are possible within the scope of the inventive concept. For example, the contact-pressure pad 6 need not necessarily have the shape of a calotte, but may also have other shapes, e.g. shapes that are substantially triangular in cross-section, said shapes defining, just like the bulge 14, a slant onto which items introduced in the reception slot 5 can be pushed and then easily be fixed between the contact-pressure pad 6 and the opposed holding arm 4.

In addition, a plurality of contact-pressure pads 6 bulging from the holding arm 3 can be provided.

When the holding/contact-pressure pad 6 overlaps with the opposed holding arm 4 in the direction of insertion E, an overlapping portion may also be implemented as a locking projection or a fixing strip projecting from the holding arm 4 transversely to the direction of insertion E in the direction of the reception slot. When the contact-pressure pad 6 is implemented such that it projects into an opening in the holding arm 4 for an overlapping mode of arrangement, it is not absolutely necessary that this opening is implemented as a throughhole, but the opening may also be implemented as a simple recess in the holding arm 4.

What is claimed is:

1. A holder clip (1) for cards, such as identification cards, comprising two holding arms (3,4) interconnected by a yoke (2) and defining between them a reception slot (5) which is open in a direction opposite to the direction of card insertion (E), characterized in that at least one of the two holding arms (3, 4) is provided with at least one contact-pressure pad (6) bulging, at least in certain sections thereof, towards the respective other holding arm (3, 4), said contact-pressure pad (6) consisting of a material that is softer than the material of the holding arm (3, 4), wherein the holding arm (3) provided with the contact-pressure pad (6) has formed therein an opening (21) into which the contact-pressure pad (6) is, at least partially, inserted.

2. A holder clip (1) according to claim 1, characterized in that the contact-pressure pad (6) overlaps, at least in certain sections thereof, the opposed holding arm (3, 4) in the direction of insertion (E).

3. A holder clip (1) according to claim 1 or 2, characterized in that one of the holding arms (3, 4) is provided with an opening into which the contact-pressure pad (6) of the other holding arm (3,4) projects.

4. A holder clip (1) according to claim 1, characterized in that, on a side (17) facing away from the reception slot (5), the contact-pressure pad (6) is provided with a recess (18) curved in the direction of the reception slot (5).

5. A holder clip (1) according to claim 1, characterized in that, at least in the direction of insertion (E), a surface (16) of the holding arm (3) facing the reception slot (5) merges with a surface (11) of the contact-pressure pad (6) essentially without any step being formed therebetween.

6. A holder clip (1) according to claim 1, characterized in that the contact-pressure pad (6) is formed such that a substance-to-substance bond exists between said contact-pressure pad (6) and one of the two holding arms (3, 4).

7. A holder clip (1) according to claim 1, characterized in that, on a side (10) facing away from the reception slot (5), the holder clip (1) comprises a fastening element (8) which extends from the yoke (2) and which is provided with fastening means (9).

8. A holder clip (1) according to claim 7, characterized in that, when seen in a lateral cross-section of the holder clip (1), the fastening element (8) extends from the middle of the yoke (2).

9. A holder clip (1) according to claim 1, characterized in that the holder clip (1) is implemented as an injection moulded part.

* * * * *